US010637176B1

(12) United States Patent
Campbell et al.

(10) Patent No.: US 10,637,176 B1
(45) Date of Patent: Apr. 28, 2020

(54) CONNECTOR ASSEMBLY WITH RETAINER

(71) Applicant: Aptiv Technologies Limited, St. Michael (BB)

(72) Inventors: Jeffrey S. Campbell, West Bloomfield, MI (US); Wesley W. Weber, Jr., Metamora, MI (US)

(73) Assignee: Aptiv Technologies Limited (BB)

( * ) Notice: Subject to any disclaimer, the term of this patent is extended or adjusted under 35 U.S.C. 154(b) by 0 days.

(21) Appl. No.: 16/353,649

(22) Filed: Mar. 14, 2019

(51) Int. Cl.

| | |
|---|---|
| ***H01R 13/42*** | (2006.01) |
| ***H01R 13/504*** | (2006.01) |
| ***H01R 4/18*** | (2006.01) |
| ***H01R 4/12*** | (2006.01) |
| ***H01R 13/62*** | (2006.01) |

(52) U.S. Cl.
CPC ..... *H01R 13/42* (2013.01); *H01R 4/12* (2013.01); *H01R 4/185* (2013.01); *H01R 13/5045* (2013.01); *H01R 13/62* (2013.01)

(58) Field of Classification Search
CPC ..... H01R 13/5812
USPC ..... 439/456–463
See application file for complete search history.

(56) References Cited

U.S. PATENT DOCUMENTS 571,761 A * 11/1896 Gulliford ..... F16G 11/00 24/129 A
3,806,992 A * 4/1974 Reimer ..... F16G 11/12 242/378.3
4,270,832 A * 6/1981 Tanabe ..... H01R 24/568 439/457
4,881,909 A * 11/1989 Blackman ..... A47L 9/246 439/191
5,255,866 A * 10/1993 Campolo ..... H01R 13/6392 24/129 A
5,416,273 A * 5/1995 Maciejewski ..... H01R 13/562 114/215
5,935,159 A * 8/1999 Cross, Jr. ..... A61N 1/056 607/116
6,249,708 B1 * 6/2001 Nelson ..... A61N 1/056 607/122
6,250,951 B1 * 6/2001 Milner ..... H01R 13/6463 174/27
6,406,325 B1 * 6/2002 Chen ..... H01R 13/6463 439/344
6,524,128 B2 * 2/2003 Marowsky ..... H01R 13/6463 439/418
6,989,511 B1 * 1/2006 Tsai ..... B23K 3/0338 219/229
7,018,241 B2 * 3/2006 Caveney ..... H01R 13/514 439/418

(Continued)

*Primary Examiner* — Ross N Gushi
(74) *Attorney, Agent, or Firm* — Robert J. Myers

(57) ABSTRACT

A connector assembly includes a conductor retainer that is configured to relieve retain a conductor within a connector body of the connector assembly. The conductor retainer causes the conductor to helically twist at least 90 degrees about a longitudinal axis. A helical channel may be defined in the conductor retainer to cause the conductor to helically twist. Multiple conductors may be terminated within the connector assembly and the conductor retainer may define multiple helical channels. Some of the helical channels may have a right hand helical twist while others have a left hand helical twist. A method of manufacturing a connector assembly with these features is also presented.

21 Claims, 4 Drawing Sheets

(56) References Cited

U.S. PATENT DOCUMENTS 7,163,417 B2 * 1/2007 Brodin ..... H01R 9/032 439/457
7,220,149 B2 * 5/2007 Pharney ..... H01R 13/6467 439/676
7,223,112 B2 * 5/2007 AbuGhazaleh .... H01R 13/6463 439/344
7,311,659 B2 * 12/2007 Bob ..... A61B 1/012 600/139
7,395,116 B2 * 7/2008 Mehdizadeh ..... A61N 1/056 600/373
7,555,349 B2 * 6/2009 Wessman ..... A61N 1/0551 607/116
7,641,503 B1 * 1/2010 van der Horn .... H01R 13/5812 439/457
7,680,544 B1 * 3/2010 Conger ..... A61N 1/056 607/116
7,972,183 B1 * 7/2011 Lin ..... H01R 24/64 439/676
8,979,553 B2 * 3/2015 Lloyd ..... H01R 12/53 439/76.1
9,106,008 B2 * 8/2015 Inagaki ..... H01R 13/5808
9,590,351 B2 * 3/2017 Rogers ..... H01R 9/05
9,819,124 B2 * 11/2017 Oberski ..... H01R 12/515
9,905,978 B2 * 2/2018 Zebhauser ..... H01R 13/6463
9,929,506 B2 * 3/2018 Hashimoto ..... H01R 13/6272
9,968,776 B2 * 5/2018 Childers ..... A61N 1/0563
2003/0224666 A1 * 12/2003 Yuan-Huei ..... H01R 13/6463 439/676
2005/0113899 A1 * 5/2005 Cross, Jr. ..... A61N 1/05 607/122
2008/0014801 A1 * 1/2008 Milette ..... H01R 4/242 439/638
2016/0248196 A1 8/2016 Rogers
2018/0048095 A1 * 2/2018 Oberski ..... H01R 12/515
2019/0123459 A1 * 4/2019 Kimura ..... H01R 4/70

* cited by examiner

CONNECTOR ASSEMBLY WITH RETAINER

TECHNICAL FIELD OF THE INVENTION

The invention generally relates to a connector assembly configured to retain to a conductor within the connector assembly, particularly to a connector assembly with a retainer that includes features which helically twists the conductors.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

Figure 1:
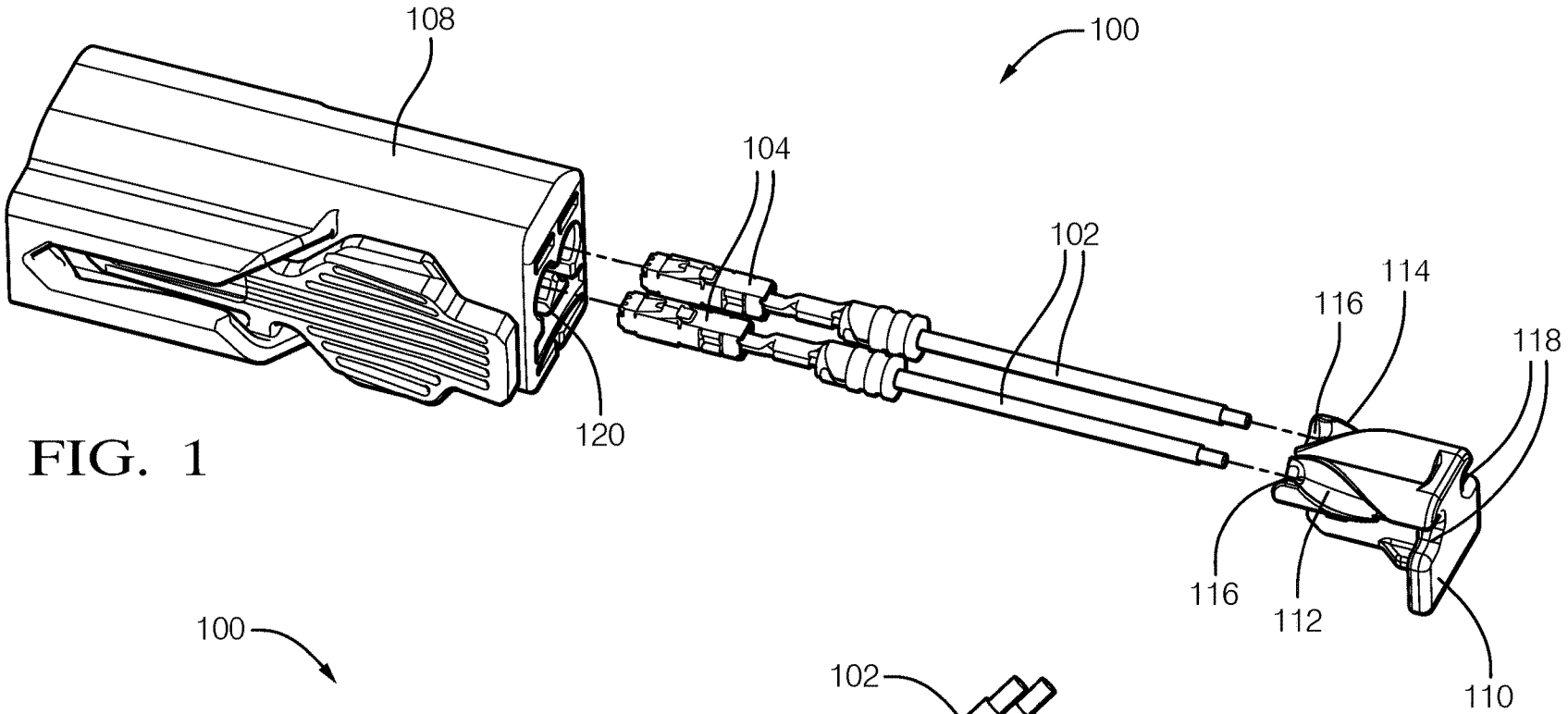
FIG. 1 is an exploded perspective view of a connector assembly according to one embodiment of the invention.
Figure 5:
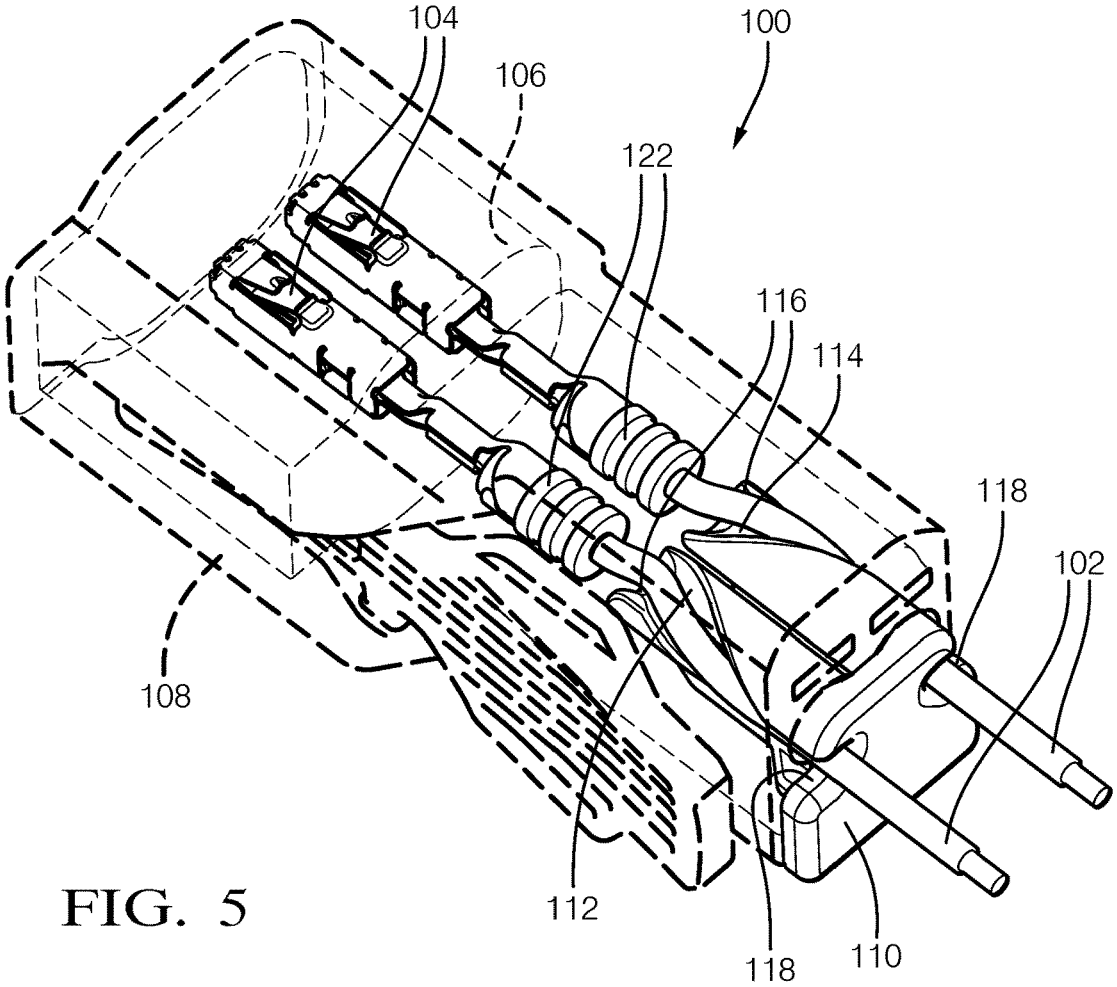
FIG. 5 is a cut away view of the connector assembly of FIG. 1 according to one embodiment of the invention.

FIG. 1 illustrates a nonlimiting example of a connector assembly 100 used to interconnect elongate conductors. In this illustrated example, the conductors are insulated wire electrical cables, hereinafter referred to as cables 102. Electrical terminals 104 formed of a conductive material, such as a tin-plated copper material, are attached to ends of the cables 102. These terminals 104 are received and retained within terminal cavities 106 (see FIG. 5) defined within a connector body 108 of the connector assembly 100. The connector body 108 is formed of a dielectric material, such as polyamide (PA, also known as nylon) or polybutylene terephthalate (PBT). The connector assembly 100 further includes a conductor retainer, hereinafter referred to as a cable retainer 110 that defines a first helical channel 112 and a second helical channel 114. The first helical channel 112 extends along a first longitudinal axis $X_1$ and is substantially parallel to a longitudinal axis of the connector body. The second helical channel 114 extends along a second longitudinal axis $X_2$ and is substantially parallel to the first longitudinal axis $X_1$. As used herein, substantially parallel is within 15 degrees of absolutely parallel. The cable retainer 110 also defines an entrance opening 116 at one end of each of the helical channels 112, 114 through which the cables 102 enter the cable retainer 110 and an exit opening 118 on the other end of each of the helical channels 112, 114 through which the cables 102 exit the cable retainer 110. The cable retainer 110 is also formed of a dielectric material, such as PA or PBT. The cables 102 are disposed within the pair of helical channels 112, 114. Each of the helical channels 112, 114 has a helical twist of at least 90 degrees. The helical channels 112, 114 cause a section of each of the cables 102 to form a helical twist generally having the same degree of twist as the helical channels 112, 114.

The cable retainer 110 may advantageously be formed using an additive manufacturing process, e.g. 3D printing, stereolithography, digital light processing, fused deposition modeling, fused filament fabrication, selective laser sintering, selecting heat sintering, multi-jet modeling, multi-jet fusion, electronic beam melting, and/or laminated object manufacturing. An additive manufacturing process avoids the complicated tooling that would be required to form the helical channels 112, 114 in the cable retainer 110 using an injection molding process typically used to form the dielectric parts of a connector assembly. An additive manufacturing process also avoids material waste associated with material removal processes that could alternatively be used to form the cable retainer 110, such as milling, or grinding.

As illustrated in the nonlimiting example of FIG. 1, each helical channel 112, 114 is an open channel having a generally U-shaped cross section. The width of each helical channel 112, 114 is greater than a diameter of one of the cables 102. The helix angle of each of the helical channels 112, 114 is between 15 and 45 degrees. As used herein, the helix angle is the angle formed between either of the helical channels 112, 114 and the longitudinal axes $X_1$ or $X_2$.

As shown in the nonlimiting example of FIG. 1, the first helical channel 112 has a right hand helical twist and the second helical channel 114 has a left hand helical twist. That is to say, the first helical channel 112 twists in a clockwise direction along the first channel from the entrance opening 116 to the exit opening 118 while the second helical channel 114 twists in a counterclockwise direction along the second channel from the entrance opening 116 to the exit opening 118. Alternative embodiments of the cable retainer having two or more helical channels may be envisioned in which all of the helical channels are only twist in a clockwise direction or only twist in a counterclockwise direction.

Figure 2:
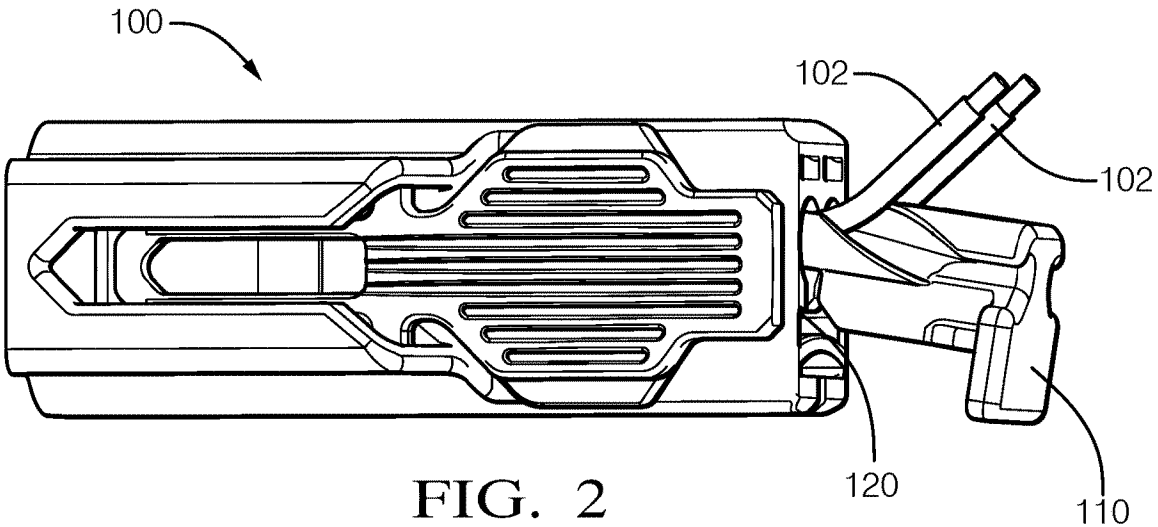
FIG. 2 is a partially assembled view of the connector assembly of FIG. 1 according to one embodiment of the invention.
Figure 3:
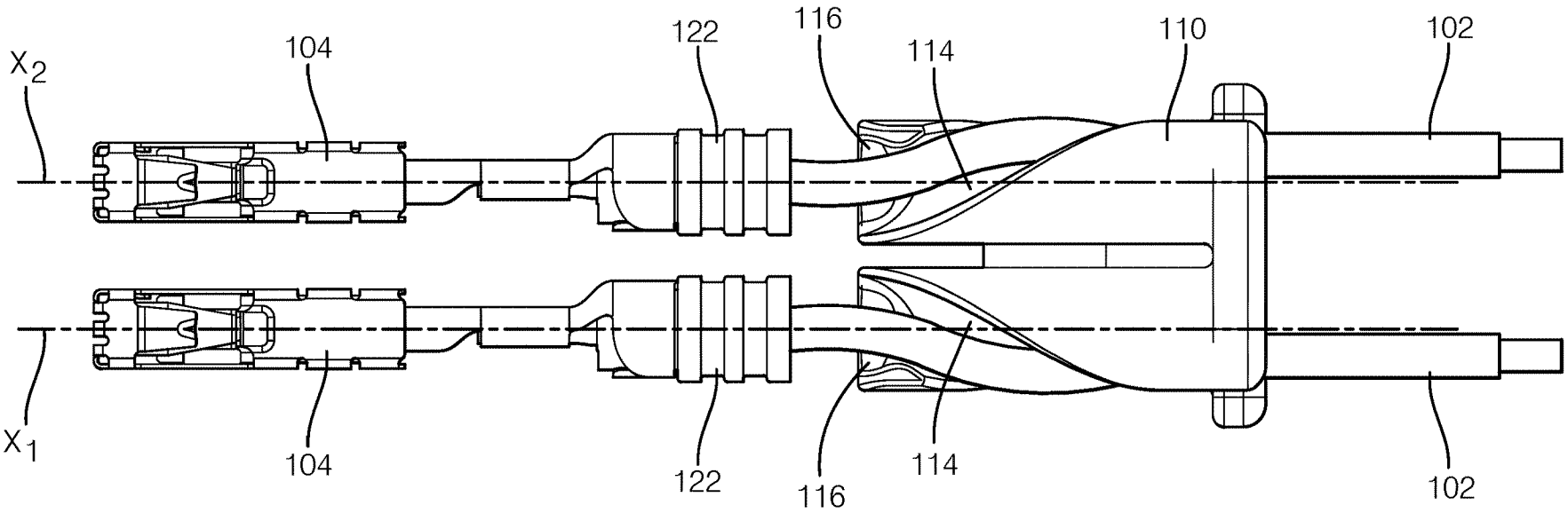
FIG. 3 is a top plan view of a conductor retainer and conductors of the connector assembly of FIG. 1 according to one embodiment of the invention.
Figure 4:
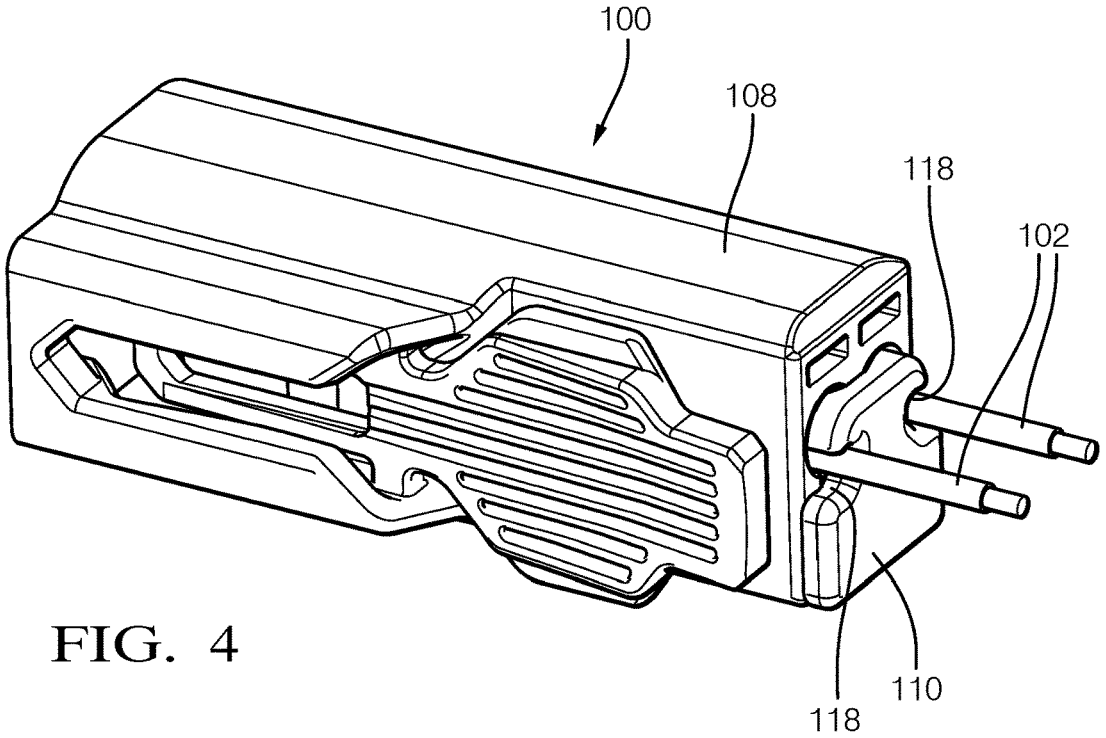
FIG. 4 is a fully assembled view of the connector assembly of FIG. 1 according to one embodiment of the invention.

FIGS. 2 through 4 illustrate a non-limiting process of assembling the connector assembly 100. As shown in FIG. 2, the terminals 104 are inserted within the connector body 108 and the cables 102 extends from a rear opening 120 in the connector body 108. As further shown in FIG. 2, the cables 102 are then inserted into the virtually oriented entrance openings 116 of the cable retainer 110. As shown in FIG. 3, the cables 102 are placed in the entrance opening 116 in each of the helical channels 112, 114. The cables 102 contact the inner surfaces of the helical channels 112, 114 and are twisted within the helical channels 112, 114 as the cable retainer 110 is pushed into the rear opening 120 in the connector body 108. The inventors have discovered that providing the helix angle of each of the helical channels 112, 114 in a range between 15 and 45 degrees facilitates a self-wrapping of the cables 102 in the helical channels 112, 114 as the cable retainer 110 is pushed into the rear opening 120. The cables 102 then exit the helical channels 112, 114 through the horizontally oriented exit openings 118. In this nonlimiting example, the entrance openings 116 and exit openings 118 are offset by about 90 degrees. The entrance openings 116 are generally aligned with the longitudinal axes $X_1$ and $X_2$ and the exit openings 118 are laterally offset from the longitudinal axes $X_1$ and $X_2$.

The cables 102 contact inner side walls of the helical channels 112, 114 as the cables 102 are wrapped within the helical channels 112, 114. Reaction forces are provided by the side walls and are applied in different axial directions as the cables 102 extend along the helical channels 112, 114, thereby dampening vibrations applied to the cables 102 in more than axial plane and reducing vibration transmitted by the cables 102 to the terminals 104 that could cause fretting corrosion when the terminals 104 are mated with corresponding mating terminals (not shown).

As shown in FIG. 4, the cable retainer 110 is fully inserted within the rear opening 120 and is attached to the connector body 108. In the illustrated embodiment, the cable retainer 110 is attached the connector body 108 by an interference fit between the cable retainer 110 and the rear opening 120 of the connector body 108. In alternative embodiments, the cable retainer 110 may be attached to the connector body 108 by other means, such as latching features, threaded fasteners, or adhesives.

The cables 102 in the illustrated non-limiting example of FIG. 1 have cable seals 122 attached to each of the cables 102. The cable seals 122 are configured to inhibit the intrusion of contaminants, such as water, oil, or dirt, through the rear opening 120 into the terminal cavity 106. The cable retainer 110 may be further configured to retain the cable seals 122 and the terminals 104 within the connector body 108 as illustrated in the non-limiting example shown in FIG. 6.

Figure 6:
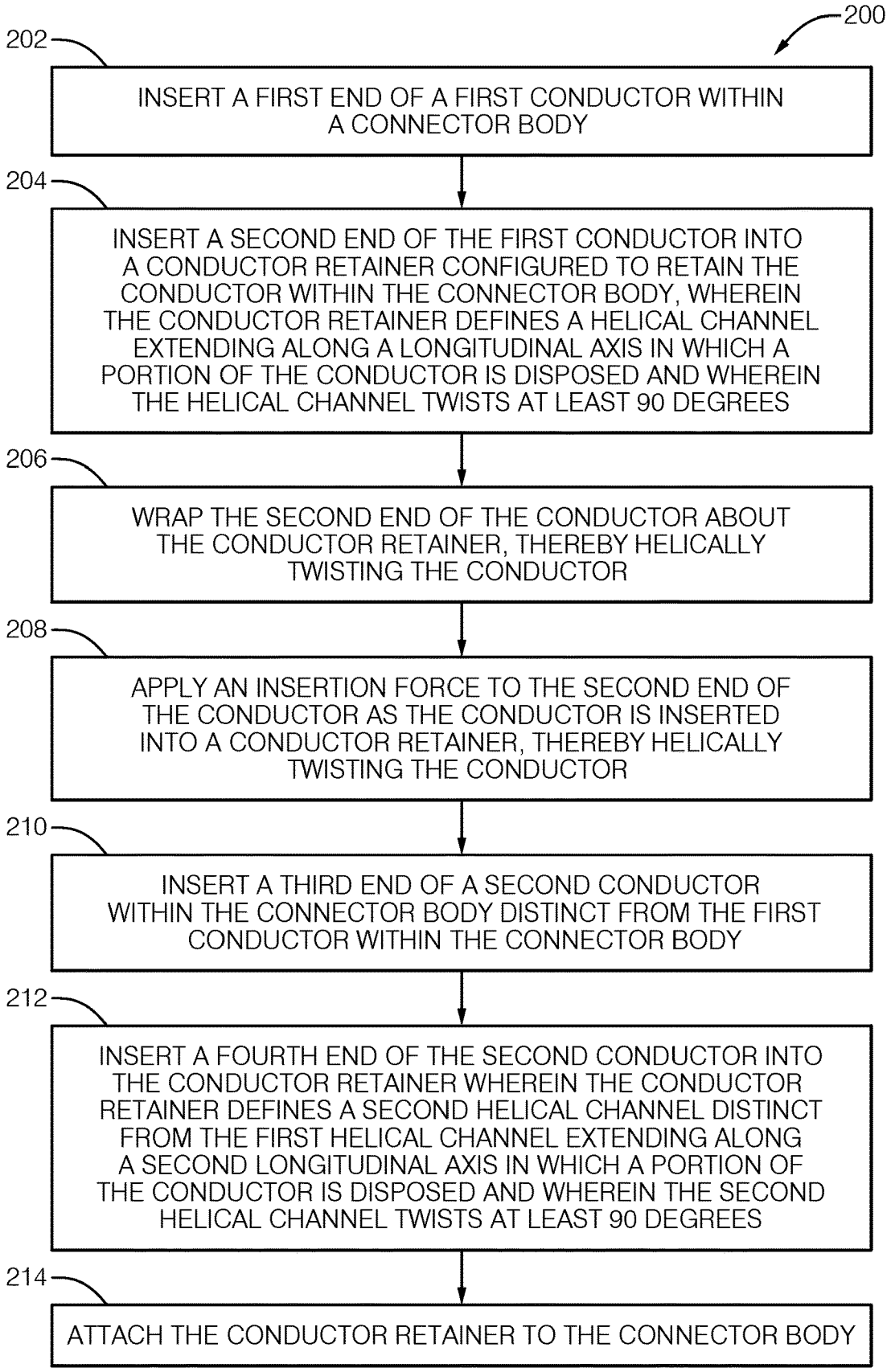
FIG. 6 is a flow chart of a method of manufacturing the connector assembly of FIG. 1 according to another embodiment of the invention.

FIG. 6 illustrates a non-limiting example of a method 200 of manufacturing a connector assembly, such as the connector assembly 100. The method 200 includes the following steps:

STEP 202 includes inserting a first end of a first conductor 102, such as a first cable 102, in a connector body 108 as shown in the nonlimiting example of FIG. 2;

STEP 204 includes inserting a second end of the first conductor 102 into a cable retainer 110 that is configured to retain the first conductor 102 within the connector body 108 as shown in FIG. 3. The cable retainer 110 defines a first helical channel 112 that extends along the longitudinal axis $X_1$ in which a portion of the first conductor 102 is disposed. The first helical channel 112 helically twists at least 90 degrees. Insertion of the first conductor 102 into the first helical channel 112 causes the first conductor 102 to helically twist at least 90 degrees;

STEP 206 is includes wrapping the second end of the conductor about the conductor retainer, thereby helically twisting the conductor. STEP 206 may be performed when the first helical channel 12 is an open channel having a U-shaped cross section. STEP 206 is performed prior to STEP 214.

STEP 208 includes applying an insertion force to the second end of the conductor as the conductor is inserted into a conductor retainer, thereby helically twisting the conductor. STEP 208 may be performed when the first helical channel 112 is a closed channel. STEP 208 is performed prior to STEP 214.

STEP 210 includes inserting a third end of a second conductor 102, such a second cable 102, that is distinct from the first conductor 102 within the connector body 108 as shown in the nonlimiting example of FIG. 2;

STEP 212 includes inserting a fourth end of the second conductor 102 into the cable retainer 110 as shown in FIG. 3. The cable retainer 110 defines a second helical channel 114 that is distinct from the first helical channel 112. The second helical channel 114 extends along the longitudinal axis $X_2$. A portion of the conductor is disposed within the second helical channel 114. The second helical channel 114 twists at least 90 degrees. Insertion of the second conductor 102 into the second helical channel 114 causes the second conductor 102 to helically twist at least 90 degrees; and STEP 214 includes attaching the cable retainer 110 to the connector body 108 as shown in the nonlimiting example of FIG. 4.

According to a non-limiting example shown in FIG. 3, the first helical channel 112 has a right hand helical twist and the second helical channel 114 has a left hand helical twist. While the illustrated embodiment of the connector assembly 100 accommodates a single pair of cables 102, alternative embodiments of the connector assembly may accommodate a single cable or may accommodate more than two cables. The cables may be arranged in cable pairs in which the cable retainer causes one cable of the cable pair to have a right hand helical twist while the other cable of the cable pair to has a left hand helical twist.

According to a non-limiting example shown in FIG. 3, the helical channels 112, 114 are open channels. In alternative embodiments of the connector assembly, the cable retainer may define closed helical channels rather than open helical channels. These closed helical channels may have a generally circular cross section. The cables may be inserted into the cable retainer through entrance openings on the front side of the cable retainer and exit the cable retainer through exit openings on the back side of the cable retainer opposite the front side. The exit openings are laterally offset from the entrance openings. The cross sectional diameter of the helical channels is greater than the diameter of the cables. In this alternative embodiment, the cables form a helical twist similar to that shown in FIG. 3 as they pass through the helical channels due to the insertion forces applied to the cables and contact with the inner walls of the helical channels.

The example presented herein is directed to a connector assembly 100 in which the conductors are insulated electrical cables 102. However, alternative embodiments of the connector assembly may be envisioned in which the conductors are fiber optic cables, pneumatic tubes, hydraulic tubes, or a hybrid assembly having a combination of any of these conductors. These conductors may be terminated by fittings which may be characterized as terminals.

According to another alternative embodiment of the connector assembly, the cable retainer may be moveable attached to the connector body and may be moved from a pre-staged position that allows insertion of the terminals into the terminal cavities to a staged position in which the cable retainer is fully seated in the rear opening; similarly situated as in the example illustrated in FIG. 4.

Accordingly, a connector assembly 100 and a method 200 of manufacturing a connector assembly is presented. The connector assembly 100 includes a cable retainer 110 that provides the benefit of isolating motion of the cables 102 from the terminals 104 so that motion and forces acting on the cables 102 extending beyond the connector body 108 cannot induce motion or forces on the terminals 104 within the connector body 108. This isolation of the terminals 104 reduces relative motion fretting and plating wear at the contact interface between the terminals 104 and corresponding mating terminals (not shown), thereby increasing the reliability and service life of the connector assembly 100.

Because the cables 102 of the connector assembly 100 are not pinched or clamped by the cable retainer 110 as in prior art cable retainers, the fit between the cables 102 and the cable retainer 110 is not prone to loosening due to thermal cycling of the connector assembly 100 as in prior art cable retainers that rely on cable pinching or clamping. Therefore, the connector assembly 100 is suited for applications that experience changes in temperature, such as vehicle engine bay applications. Since the U-shaped helical channels 112, 114 are sized to be larger than the diameter of the cables 102, the cables 102 fit within the helical channels 112, 114 without interference. Because an interference fit is not required, the cable retainer 110 may accommodate any cable size as long as the diameter of the cables 102 is less than the width of the helical channels 112, 114.

Without subscribing to any particular theory of operation, the cable retainer 110 effectively isolates motion of the cables 102 from the terminals 104 because the cables 102 are engaged with the helical channels 112, 114 over a length that is at least several times longer than the cable diameter. Additionally, the helical channels 112, 114 isolate "in plane" motion of the cables 102 from the terminals 104 since the helical channels 112, 114 twist by at least 90 degrees.

The cable retainer 110 further provides the benefit of acting as a cable seal retainer when connector assembly 100 includes cable seals 122.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

We claim:

1. A connector assembly, comprising:

a conductor retainer configured to retain a conductor within a connector body of the connector assembly, wherein the conductor retainer defines a helical channel extending along a longitudinal axis which causes the conductor to helically twist at least 90 degrees about the longitudinal axis, wherein an insertion force applied to the conductor causes the conductor to helically twist as the conductor is inserted within the conductor retainer, and wherein the conductor contacts an inner surface of the helical channel and is twisted within the helical channel by the insertion force applied to the conductor retainer as the conductor retainer is pushed into a rear opening in the connector body.

2. The connector assembly according to claim 1, wherein the conductor helically twists after the conductor is inserted within a first opening defined by the conductor retainer and the conductor exits a second opening defined by the conductor retainer.

3. The connector assembly according to claim 1, wherein the conductor contacts an inner side wall of a helical channel defined within the conductor retainer as the conductor is helically twisted.

4. A connector assembly, comprising:

a conductor retainer configured to retain a first conductor within a connector body of the connector assembly, wherein the conductor retainer causes the first conductor to helically twist at least 90 degrees about a first longitudinal axis and further configured to retain a second conductor distinct from the first conductor within the connector body and wherein the conductor retainer causes the second conductor to helically twist at least 90 degrees about a second longitudinal axis, wherein the first conductor and the second conductor have terminals attached, wherein the terminals are retained within the connector body, wherein the first conductor and the second conductor have conductor seals attached, and wherein the conductor retainer is further configured to retain the conductor seals within the connector body.

5. The connector assembly according to claim 4, wherein the first conductor has a right hand helical twist and the second conductor has a left hand helical twist.

6. The connector assembly according to claim 4, wherein the first conductor and the second conductor are selected from a group consisting of: wire electrical cables, fiber optic cables, pneumatic tubing, and hydraulic tubing.

7. The connector assembly according to claim 4, wherein helical twisting of the conductor is configured to inhibit transmission of motion of the first conductor and the second conductor to the terminals.

8. A connector assembly, comprising:

a conductor retainer configured to retain a conductor within a connector body, wherein the conductor retainer defines a helical channel in the conductor retainer extending along a longitudinal axis in which a portion of the conductor is disposed, wherein the helical channel twists at least 90 degrees, wherein the conductor contacts an inner surface of the helical channel and is twisted within the helical channel by an insertion force applied to the conductor retainer as the conductor retainer is pushed into a rear opening in the connector body.

9. The connector assembly according to claim 8, wherein the helical channel is an open channel having a U-shaped cross section and wherein a width of the helical channel is greater than a diameter of the conductor.

10. The connector assembly according to claim 8, wherein the conductor contacts an inner side wall of the helical channel as the conductor is twisted within the helical channel.

11. The connector assembly according to claim 8, wherein the helical channel is a closed channel and wherein a diameter of the helical channel is greater than a diameter of the conductor.

12. The connector assembly according to claim 8, wherein a helix angle of the helical channel is between 15 and 45 degrees.

13. A connector assembly, comprising:

a conductor retainer configured to retain a conductor within a connector body, wherein the conductor retainer defines a helical channel in the conductor retainer extending along a longitudinal axis in which a portion of the conductor is disposed, wherein the helical channel twists at least 90 degrees, wherein the conductor is a first conductor the helical channel is a first helical channel and the longitudinal axis is a first longitudinal axis, wherein the conductor retainer is further configured to retain a second conductor separate from the first conductor within the connector body, wherein the conductor retainer defines a second helical channel distinct from the first helical channel extending along a second longitudinal axis in which a portion of the second conductor is disposed and wherein the second helical channel twists at least 90 degrees.

14. The connector assembly according to claim 13, wherein the first helical channel has a right hand helical twist and the second helical channel has a left hand helical twist.

15. The connector assembly according to claim 13, wherein the first conductor and the second conductor are selected from a group consisting of: wire electrical cables, fiber optic cables, pneumatic tubing, and hydraulic tubing.

16. The connector assembly according to claim 15, wherein the first conductor and the second conductor have terminals attached and wherein the terminals are retained within the connector body.

17. The connector assembly according to claim 16, wherein the first conductor and the second conductor have conductor seals attached and wherein the conductor retainer is further configured to retain the conductor seals within the connector body.

18. The connector assembly according to claim 13, wherein the helical channel is an open channel having a U-shaped cross section and wherein a width of the helical channel is greater than a diameter of the conductor.

19. The connector assembly according to claim 13, wherein the conductor contacts an inner side wall of the helical channel as the conductor is twisted within the helical channel.

20. The connector assembly according to claim 13, wherein the helical channel is a closed channel and wherein a diameter of the helical channel is greater than a diameter of the conductor.

21. The connector assembly according to claim 13, wherein a helix angle of the helical channel is between 15 and 45 degrees.

* * * * *